US005937756A

United States Patent [19]

Kishine et al.

[11] Patent Number: 5,937,756

[45] Date of Patent: Aug. 17, 1999

[54] TENSION CONTROL SYSTEM FOR WEB IN FORM PRINTING PRESS

[75] Inventors: Toshiaki Kishine; Satoru Katou, both of Chiba, Japan

[73] Assignee: Miyakoshi Printing Machinery Co., Ltd., Chiba, Japan

[21] Appl. No.: 09/000,763

[22] Filed: Dec. 30, 1997

[30] Foreign Application Priority Data

Nov. 10, 1997 [JP] Japan ..... 9-306751

[51] Int. Cl.[6] ..... B41F 5/06

[52] U.S. Cl. ..... 101/228; 101/181

[58] Field of Search ..... 101/181, 183, 101/216, 219, 225, 231, 232, 228, 226, 178; 226/195, 193, 38, 34, 45

[56] References Cited

U.S. PATENT DOCUMENTS

| | | | |
|---|---|---|---|
| 4,391,190 | 7/1983 | Metzler | 101/181 |
| 4,722,275 | 2/1988 | Taguchi et al. | 101/228 |
| 4,785,734 | 11/1988 | Kawana et al. | 101/219 |
| 5,117,753 | 6/1992 | Mamberer | 101/231 |
| 5,377,589 | 1/1995 | Kruger et al. | 101/181 |

FOREIGN PATENT DOCUMENTS 4-51456 8/1992 Japan .

10-17186 1/1998 Japan .

*Primary Examiner*—Christopher A. Bennett

*Attorney, Agent, or Firm*—Wenderoth, Lind & Ponack, L.L.P.

[57] ABSTRACT

A tension control system for a web in a form printing press permits arbitrary setting of tensions of a web at respective zones between an impression cylinder and respective rollers. The system includes tension detectors located on the upstream side of an impression cylinder in the printing portion and upstream side of a tension roller in the processing portion, for detecting tension on the web, speed adjusting mechanisms provided at least in respective drive systems of the impression cylinder and the tension roller adjacent to respective tension detectors, for adjusting respective rotation speeds of the impression cylinder and the tension roller on the basis of output signals from controllers, to which detected signals of respective tension detectors are fed back and tension setting devices associated with respective controllers. The controllers compare the detected values from respective tension detectors with set values from the tension setting devices and output the output signals for controlling rotation speeds of the impression cylinder and the tension roller so that differences between the compared values are reduced to zero.

1 Claim, 2 Drawing Sheets

TENSION CONTROL SYSTEM FOR WEB IN FORM PRINTING PRESS

BACKGROUND OF THE INVENTION

1. Field of the Invention

The present invention relates generally to a business form printing press which performs a sequence of operations of printing and processing, such as punching, perforating and so forth. More specifically, the invention relates to a tension control system in a business form printing press, which maintains a tension on a printing web at an appropriate level for avoiding registration error upon printing or processing.

2. Description of the Related Art

It is important for a business form printing press to maintain tension between a plurality of roller nips in a web feeding portion, a printing portion, a processing portion and a folding portion at appropriate values (the same value, or gradually increased values) during operation, and thus to avoid fluctuation of expansion of a web for achieving high precision in registration in printing and processing.

However, in the conventional business form printing press, the following problems have been encountered.

(1) It has not been possible to appropriately control relationships of tension by employing means for numerical setting thereof, or the like, in relation to variations of tensions on the web between the roller nips due to thickness of the web rolled on a cylinder and a drawing ratio determined by a finishing diameter of the cylinder. The prior art mentioned hereinabove is disclosed in Japanese Patent Examined Publication No. 4(1992) - 51456.

(2) In the business form printing press, printing cylinders have to be changed every time upon variation of longitudinal size. Therefore, it is difficult to appropriately maintain a drawing ratio of an impression cylinder which is determined by a finishing diameter of the impression cylinder between the web feeding portion to the processing portion and thus to cause fluctuation of the drawing ratios between the nips. This results in variation of tension on the web per respective roller nip at every occasion of changing of the printing cylinder.

(3) In case of printing using a dampening water, the web is easily expanded. Therefore, unless the tension acting on the web is lowered in comparison with that of the printing unit which does not use the dampening water, the longitudinal length of a printed area becomes shorter as dried. For this reason, the tension to act on the web has to be individually adjusted for each printing unit. However, the conventional business form printing press does not permit such adjustment.

(4) In the processing portion and the folding portion, feeding of web is performed by friction by locally exerted pressure of a tension roller and a rubber roller to easily cause slip by penetration of air between the web and the roller during rotation. This is easily caused in a high speed range. Therefore, tension in the high speed range becomes unstable to cause registration error relative to the printed area in processing or registration error between respective processing units, such as a punching unit, a transverse perforating unit and so forth.

(5) In the processing portion, it is desired to lower the tension acting on the web after a transverse perforating process, especially in the case where perforations are large to be easily cut or perforations are formed in a thin web. However, the conventional business form printing press does not permit adjustment of tension, individually.

In such circumstances, it has been desired to permit adjustment of the tension to act on the web between rollers in the printing portion, the processing portion and the folding portion, individually.

SUMMARY OF THE INVENTION

Therefore, it is an object of the present invention to provide a business form printing press, in which tension on a printing web can be adjusted at each of individual zones between rollers in a printing portion, a processing portion and so forth.

According to the present invention, a tension control system for a web in a form printing press, including a printing portion and a processing portion, comprises:

tension detectors located on the upstream side of an impression cylinder in the printing portion and upstream side of a tension roller in the processing portion, for detecting tension on the web;

speed adjusting means provided at least in respective drive systems of the impression cylinder and the tension roller adjacent to respective tension detectors, for adjusting respective rotation speeds of the impression cylinder and the tension roller on the basis of output signals from controllers, to which detected signals of respective tension detectors are fed back;

tension setting devices associated with respective controllers; and when the controllers compare the detected values from respective tension detectors and set values from the tension setting devices and output the output signals for controlling rotation speeds of the impression cylinder and the tension roller for reducing differences between compared values to zero.

The rotation speeds of the impression cylinder in the printing portion and the tension rollers in the processing portion adjacent tension detectors respectively located on the upstream sides thereof, can be controlled finely by the output signals from the controllers. The controllers compare the set values set by the tension setting devices and the detected values of the tension fed back from respective tension detectors to output signals for adjusting rotation speeds of the impression cylinder and respective tension rollers for adjusting differences of the set values and the detected values to zero. Thus, the tension on the web at respective tension detectors can be adjusted to the values set at the tension setting devices.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the present invention.

Figure 1:
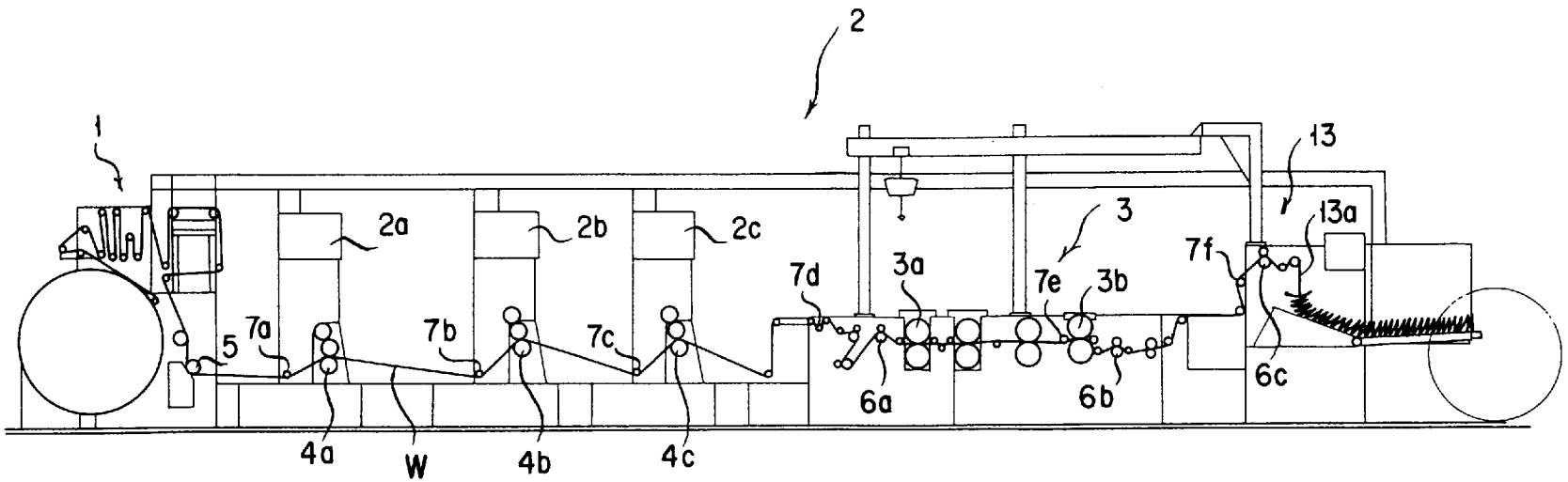
FIG. 1 is a front elevation showing the preferred embodiment of a business form printing press according to the present invention.

FIG. 1 shows a three color business form printing press, to which the present invention is applicable.

In FIG. 1, the reference numeral 1 denotes a web feeding portion, 2 denotes a printing portion which is constituted of first, second and third printing units 2*a*, 2*b* and 2*c* performing printing of a first color, a second color and a third color, in sequential order, 3 denotes a processing portion constituted of a punching unit 3*a* and a transverse perforating unit 3*b*, 13 denotes a folding portion for folding a web W in zigzag fashion, and 13*a* denotes a folding unit to be employed in the folding portion 13. The reference numerals 4*a*, 4*b* and 4*c* denote impression cylinders of respective printing units 2*a*, 2*b* and 2*c*.

Between the printing unit 2*a* located at the most upstream position of the printing portion 2 and a web feeding portion 1, a web feeding roller 5 is provided. Also, between the printing unit 2*c* located at the most downstream position and the punching unit 3*a* of the processing portion 3, a first tension roller 6*a* is provided. On the other hand, on the downstream side of the transverse perforating unit 3*b* of the processing portion 3, a second tension roller 6*b* is arranged, and on the upstream side of the folding unit 13*a*, a third tension roller 6*c* is arranged.

On immediate upstream side positions of respective impression cylinders 4*a*, 4*b* and 4*c* of respective printing units 2*a*, 2*b* and 2*c* in the printing portion 2, and on immediate upstream side positions of respective first, second and third tension rollers 6*a*, 6*b* and 6*c*, tension detectors 7*a*, 7*b*, 7*c*, 7*d*, 7*e* and 7*f* are disposed for constantly detecting tensions Ta, Tb, Tc, Td, Te and Tf on the web W.

As the tension detectors 7*a*, 7*b*, 7*c*, 7*d*, 7*e* and 7*f*, fine displacement type tension detectors which are generally available in the market, can be employed.

Figure 2:
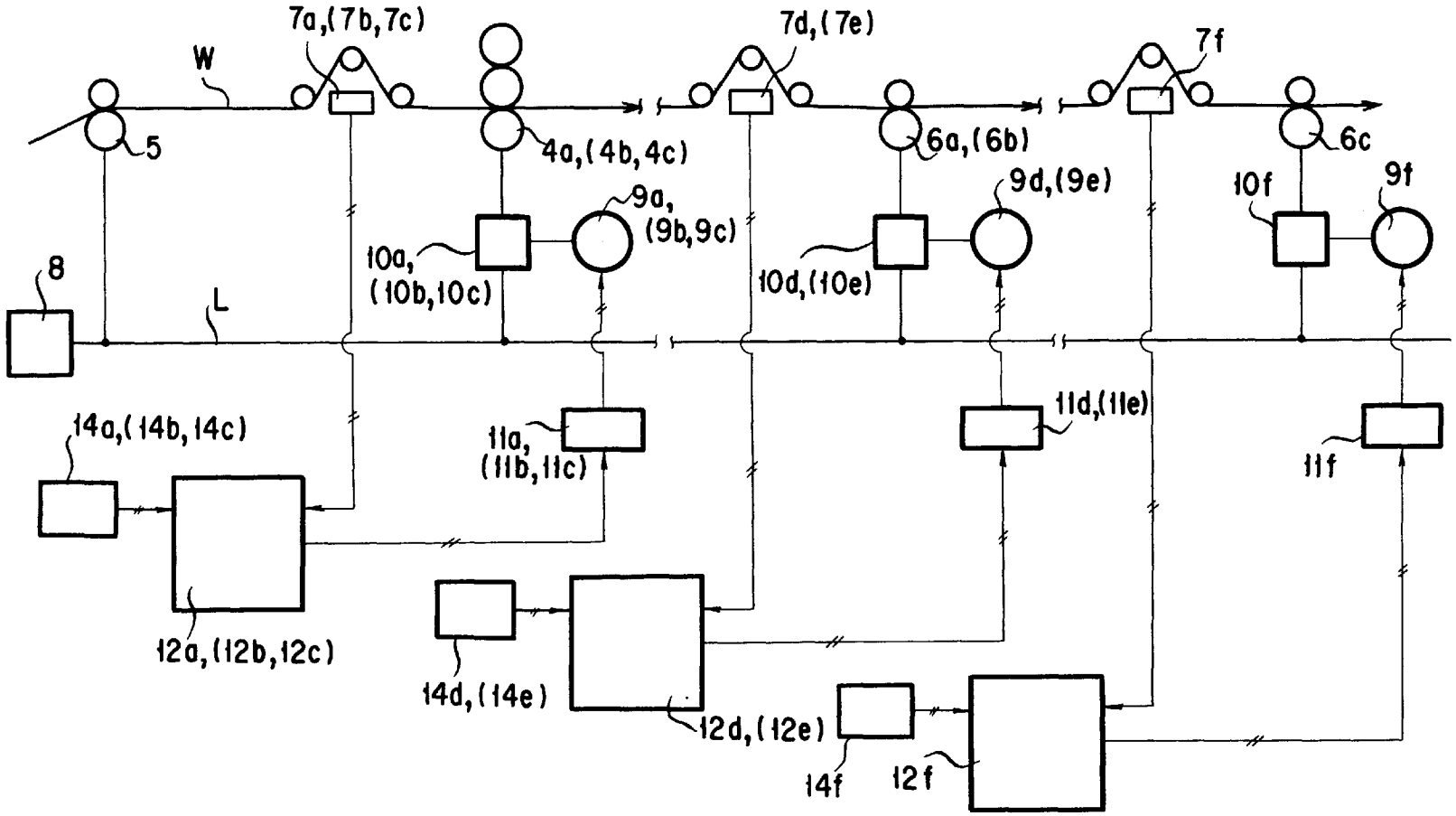
FIG. 2 is an explanatory illustration showing the major part of the preferred embodiment of the business form printing press according to the invention.

FIG. 2 shows a driving mechanism of the business form printing press shown in FIG. 1. In FIG. 2, the reference numeral 8 denotes a main motor which is designed to be driven synchronously with respective driving portions of the printing press via a driving line L. The web feeder roller 5 is designed to be directly driven by the main motor 8. On the other hand, respective impression cylinders 4*a*, 4*b* and 4*c* of respective printing units 2*a*, 2*b* and 2*c* are driven by the main motor 8 via differential gear units 10*a*, 10*b* and 10*c* which are controlled by DC servo motors 9*a*, 9*b* and 9*c*, respectively.

On the other hand, respective first, second and third tension rollers 6*a*, 6*b* and 6*c* are also driven by the main motor 8 via differential gear units 10*d*, 10*e* and 10*f* which are controlled by DC servo motors 9*d*, 9*e* and 9*f*. It should be noted that while not illustrated in FIG. 2, units in the processing portion 3 and the folding portion 13, respectively, are also driven through the driving line L.

Respective DC servo motors 9*a* to 9*f* are controlled by signals from respective controllers 12*a*, 12*b*, 12*c*, 12*d*, 12*e* and 12*f* via respective motor drivers 11*a*, 11*b*, 11*c*, 11*d*, 11*e* and 11*f*. Rotation speeds of respective impression cylinders 4*a* to 4*c* and respective tension rollers 6*a* to 6*c* (hereinafter referred to as respective controlled rotary bodies) are finely adjusted individually relative to a rotation speed of the web feeding roller 5 which is driven by the main motor directly, by the signals from the controllers 12*a* to 12*f*.

Among respective tensions Ta to Tf of the web W at respective immediate upstream positions of respective controlled rotary bodies, the tension Ta of the upstream side of the first impression cylinder 4*a* is built up by a difference of rotation speeds of the first impression cylinder 4*a* and the web feeding roller 5 located on the upstream side of the first impression cylinder 4*a*. The tensions Ta to Tf on the web W of the immediate upstream side of the second impression cylinder 4*a* and subsequent controlled rotary bodies, respectively, are built up by differences of rotation speeds relative to the controlled rotary bodies located at upstream side positions. Accordingly, by controlling rotation speeds of respective controlled rotary bodies relative to the rotation speed of the web feeding roller 5 to be a reference, respective tensions Ta to Tf can be controlled. Respective tensions Ta to Tf are detected by the tension detectors 7*a* to 7*f* arranged on immediate upstream sides of the respective controlled rotary bodies. The detected values are fed back to respective corresponding controllers 12*a* to 12*f*.

In respective controllers 12*a* to 12*f*, tension setting devices 14*a*, 14*b*, 14*c*, 14*d*, 14*e* and 14*f* are provided. The tension setting devices 14*a* to 14*f* are designed for numerically setting tensions of the web W on the upstream side of the corresponding controlled rotary bodies. Each of the controllers 12*a* to 12*f* compares the set value with the feedback value from a corresponding one of the tension detectors 7*a* to 7*f*. Then, each of the controllers 12*a* to 12*f* outputs a correction signal for fine adjustment of the rotation speed of the corresponding controlled rotary body to reduce the resultant value of comparison to zero.

Namely, respective motor drivers 11*a* to 11*f* finely adjust rotation speeds of corresponding DC servo motors 9*a* to 9*f* for adjusting tensions of the web W on the upstream sides of respective controlled rotary bodies to the set values by increasing and decreasing the rotation speeds (peripheral speeds) of respective controlled rotary bodies.

Depending upon the set values of respective tension setting devices 14*a* to 14*f* and the feedback values from respective tension detectors 7*a* to 7*f*, one example of the correction signals output from respective controllers 12*a* to 12*f* are shown as follow.

For example, when a set value is set at 5 kg, if the feedback value is 2 kg, the set value and the feedback value are compared with an arithmetic unit in the controller. The correction signal for increasing rotation speed of the controlled rotary body to a speed for increasing tension by 3 kg, is output from the controller. Then, the correction by the correction signal is performed until the set value and the feedback value match with each other. Subsequently, the controlled rotation body rotates at a constant speed.

As set forth above, among respective tensions Ta to Tf of the web W at immediate upstream sides of respective controlled rotary bodies, the tension Ta of the upstream side of the first impression cylinder 4*a* is built up by a difference of rotation speeds of the first impression cylinder 4*a* and the web feeding roller 5 located at the upstream side of the first impression cylinder 4*a*. The tensions Ta to Tf on the web W of the immediate upstream side of the respective second impression cylinder 4*b* and subsequent controlled rotary bodies are built up by differences of rotation speeds relative to the controlled rotary bodies located at upstream side positions. Therefore, correction of respective tensions by increasing and decreasing the rotation speed of respective controlled rotary bodies is performed in a sequential order from the upstream side controlled rotary bodies.

With the construction set forth above, respective controlled rotary bodies are rotated at rotation speeds such that generating tensions set by respective tension setting devices 14*a* to 14*f* are built up on the web W on the immediate upstream sides of respective controlled rotary bodies. At this time, fluctuation of respective tensions Ta to Tf are fed back to respective controllers 12*a* to 12*f* after being detected by respective tension detectors 7*a* to 7*f*. On the basis of these, respective corrected signals are output from the controllers 12*a* to 12*f*. Although the present invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed by the appended claims and equivalents thereof.

For instance, in the shown embodiment, there is illustrated an example, in which the tension detectors 7*a* to 7*f* are provided on immediate upstream sides of respective controlled rotary bodies and the tensions on the web W at respective upstream sides of the controlled rotary bodies can be adjusted by permitting control of rotation of respective controlled rotary bodies by respective controllers 12*a* to 12*f*. However, it is possible to provide the tension detectors 7*a*, 7*d* and 7*f* at the immediate upstream sides of the first printing unit 2*a* and the first and third tension rollers 6*a* and 6*c*, respectively, of the printing portion 2, so that the first printing unit 2*a* and the first and third tension rollers 6*a* and 6*c*, respectively, are controlled by the controllers 12*a*, 12*d* and 12*f*.

On the other hand, in the shown embodiment, while the embodiment, for which the web W processed by the punching process by the processing portion 3 and the web W provided with the transverse perforation in zigzag fashion by the holding portion 13, has been illustrated, it is possible to take up the web W at the downstream side of the processing portion 3 or in the alternative, other processes may also be performed.

According to the present invention, tensions of the web traveling through the impression cylinder of the printing portion and the processing units in the processing portion, can be easily and arbitrarily controlled at respective zones between respective units for establishing proper relationships.

Also, according to the present invention, since the tension on the web W at respective zones between respective units in the printing portion and the processing portion, can be set arbitrarily, tensions between roller nips of respective units of the overall system can be set at proper values even when a replacement of the impression cylinder is installed for variation of the longitudinal size or so forth. Therefore, unbalance of the tension between the printing units 2*a* to 2*c* due to fluctuation of diameter of the impression cylinder will never be caused so that products having no registration error in printing and processing can be obtained from the beginning.

Furthermore, according to the present invention, the tension on the web W in the processing portion where the variation of tension can be easily caused due to slip of the tension roller, can be stabilized to improve precision in registration between the printing portion 2 and the processing portion 3, or between respective processing units 3*a*, 3*b* in the processing portion 3.

In addition, according to the present invention, since the tension on the web W in respective portions can be set freely and managed by numerical value, printing and processing can be performed at a tension adapted to the condition, such as web thickness, web width and so forth. Therefore, it is suitable for repeated orders.

What is claimed is:

1. A tension control system for a web in a form printing press, including a printing portion having an impression cylinder with a drive system and a processing portion having a tension roller with a drive system, said tension control system comprising:

controllers having tension setting devices associated therewith, respectively;

tension detectors located on the upstream side of the impression cylinder in said printing portion and upstream side of the tension roller in said processing portion, for detecting tension on said web and feeding detected tension values to said controllers, respectively;

speed adjusting means provided at least in the drive system of said impression cylinder and the drive system of said tension roller adjacent to said tension detectors, respectively, for adjusting respective rotation speeds of said impression cylinder and said tension roller on the basis of output signals from said controllers, respectively; and wherein said controllers compare said detected values from said tension detectors, respectively, and set values from said tension setting devices and output said output signals for controlling rotation speeds of said impression cylinder and said tension roller for reducing differences between compared values to zero.

* * * * *